United States Patent [19]

Schlinkheider

[11] Patent Number: 4,895,497

[45] Date of Patent: Jan. 23, 1990

[54] DOUBLE ACTING PNEUMATIC DRIVEN PUMP WITH REGULATING VALVE

[75] Inventor: Wilfried Schlinkheider, Bielefeld, Fed. Rep. of Germany

[73] Assignee: Kopperschmidt-Mueller GmbH & Co. KG, Bielefeld, Fed. Rep. of Germany

[21] Appl. No.: 159,225

[22] Filed: Feb. 23, 1988

[30] Foreign Application Priority Data

Feb. 27, 1987 [DE] Fed. Rep. of Germany ..... 3706351

[51] Int. Cl.[4] ..... F04B 9/12

[52] U.S. Cl. ..... 417/403; 184/29

[58] Field of Search ..... 417/401, 402, 403, 404; 184/29; 91/341 R, 346, 347

[56] References Cited

U.S. PATENT DOCUMENTS

| | | | |
|---|---|---|---|
| 2,443,568 | 6/1948 | Palm | 91/346 X |
| 2,637,304 | 5/1953 | Dinkelkamp | 91/346 X |
| 2,740,384 | 4/1956 | Dinkelkamp et al. | 91/341 R X |
| 4,444,547 | 4/1984 | Stolz | 417/403 |

FOREIGN PATENT DOCUMENTS 3342388 6/1985 Fed. Rep. of Germany .

OTHER PUBLICATIONS

Kopperschmidt-Mueller Geratetechnic Brochure, p. 12, Kopperschmidt-Mueller GmbH & Co. KG., Fed. Rep. Germany, Oct. 1983.

*Primary Examiner*—Leonard E. Smith
*Attorney, Agent, or Firm*—Peter K. Kontler

[57] ABSTRACT

A fluid flow machine wherein a reciprocating piston type pump for a flowable material which must be subjected to a pronounced pressurizing action is operated by a double-acting pneumatic motor which is disposed at a level above and is spaced apart from the pump. The unit which regulates the admission of compressed air into and the evacuation of spent air from the motor is installed between the motor and the pump at a level immediately above a chamber for a supply of liquid medium serving to lubricate and clean the piston rod which transmits motion from the piston of the motor to the pump piston. A common cylindrical envelope which is permeable to air surrounds the motor and the regulating unit and defines a large expansion chamber for spent air to thus reduce noise when the machine is in use. The regulating unit need not extend radially beyond the motor and/or pump housing, and this unit occupies space which is invariably provided between the chamber and the motor so that the placing of the regulating unit into such space does not contribute to the bulk of the machine.

14 Claims, 2 Drawing Sheets

DOUBLE ACTING PNEUMATIC DRIVEN PUMP WITH REGULATING VALVE

BACKGROUND OF THE INVENTION

The invention relates to fluid flow machines in general, and more particularly to improvements in fluid flow machines of the type wherein a pump (such as a reciprocating piston type liquid pump) is operated by a pneumatic motor. Still more particularly, the invention relates to improvements in fluid flow machines of the type wherein the motor (normally a double-acting motor) is spaced apart from the pump and its operation is controlled by a regulating unit serving to effect the admission of pressurized fluid into and the evacuation of fluid from the chambers at opposite sides of the reciprocable piston of the motor.

Fluid flow machines of the above outlined character are often employed to bring about pronounced pressurization of liquid by resorting to a pneumatic motor wherein the admitted gaseous fluid is maintained at a relatively low pressure. Such machines are used in grease guns, hydraulic clamping devices and the like. Another very important field of application of such fluid flow machines is in conjunction with hydrostatic spray guns for liquid paints and many other types of flowable materials. The purpose of a fluid flow machine which cooperates with a spray gun is to deliver to the latter a stream of highly pressurized flowable material which is to be sprayed subsequent to electrostatic charging of its droplets or particles. For example, a so-called airless hydrostatic spray gun must receive a stream of the material to be sprayed at a pressure of 30–300 bar, depending on the nature of the material to be sprayed and on the presence or absence of means for supplying additional air (the technique relying on the utilization of additional air is known as the "airless plus" method).

A presently known fluid flow machine which is used to deliver pressurized flowable material to a spray gun is shown and described on page 12 of a brochure entitled KOPPERSCHMIDT-MUELLER Gerätetechnik (published Oct. 1983 and distributed by the assignee of the present application). The fluid flow machine which is described and shown in this brochure has a liquid-containing chamber which is disposed above the pump and beneath the motor and contains a supply of multiple-purpose liquid which is to prevent penetration of conveyed flowable material from the pump into the motor as well as to lubricate the parts which transmit motion from the piston of the pneumatic motor to the pump piston. The piston rod of the pump extends from the pump housing whenever it performs a working stroke, and the purpose of the liquid in the aforementioned chamber is to clean the piston rod of the pump as well as to lubricate the piston rod to thereby prolong the useful life of the pump and of the entire fluid flow machine. The liquid in the chamber contributes significantly to longer useful life of the sealing means in the region where the piston rod of the pump extends from the pump housing as well as of the sealing means which serves to prevent penetration of particles of paint or other material to be sprayed all the way into the interior of the pneumatic motor. If the material to be sprayed is a paint or any other hardenable substance, fragments of hardened material are especially likely to affect the fluid confining action and useful life of seals for movable parts of the pump and/or for movable parts of the motor.

The pump of the aforementioned fluid flow machine is spaced apart from the motor because the device which connects the piston rod of the pump piston with the piston rod of the piston in the housing of the motor should not contact the motor seal and/or the pump seal when the machine is in use, i.e., when the piston of the motor is reciprocated by a pressurized gaseous fluid to thereby reciprocate the pump piston so that the latter can draw and pressurize the material to be sprayed. As a rule, the chamber for the rinsing and lubricating medium is disposed above the pump housing, and the level of its top wall is determined by the upper level of the supply of liquid medium therein. The top wall of the chamber is spaced apart from the bottom end wall of the motor housing by a distance which suffices to provide between such walls a space (called lantern space) wherein the aforementioned connecting device can reciprocate and into which the piston rod of the motor can extend when the machine is in use so that the piston rod of the pump does not come in contact with the material which is conveyed and pressurized by the pump.

The means for regulating the flow of pressurized gaseous fluid to, and the flow of spent gaseous fluid from, the motor chambers of the machine which is described in the aforementioned brochure is outwardly adjacent and is disposed at one side of the motor housing. Such regulating means employs several valves which are actuated by the reciprocating piston of the pneumatic motor. A drawback of such design is that the regulating means contributes to the bulk of the fluid flow machine, particularly to the floor space requirements of the machine. Moreover, the machine is rather noisy and the motor housing must be formed with two additional openings for the valve actuating means.

A modified fluid flow machine is disclosed in German Offenlegungsschrift No. 33 42 388 of Willig. The means for regulating the flow of gaseous fluid to and from the chambers of the pneumatic motor is installed at a level above the motor. A mechanical connection is provided to transmit motion from the piston rod of the motor to the moving parts of the regulating means. To this end, it is necessary to provide an opening in one end wall of the motor housing and to adequately seal such opening around the motion transmitting part. Willig further proposes to employ the space around the regulating means as an expansion chamber for air which flows from the chambers in the motor housing to thus achieve a certain reduction of noise. An additional drawback of the proposal of Willig is that the overall length of the machine is increased by the height of the regulating means above the motor and that the height of the regulating means itself is excessive.

OBJECTS AND SUMMARY OF THE INVENTION

An object of the invention is to provide a novel and improved fluid flow machine, especially for use in conjunction with spray guns, which is simpler and more compact than the aforediscussed conventional fluid flow machines.

Another object of the invention is to provide a fluid flow machine whose useful life is longer than that of heretofore known machines.

A further object of the invention is to provide novel and improved means for regulating the operation of the pneumatic motor in the above outlined machine.

Still another object of the invention is to provide novel and improved means for collecting and evacuating condensate which gathers in the regulating means when the machine is in use.

An additional object of the invention is to provide a compact, simple and relatively inexpensive fluid flow machine which can be used with many presently known spray guns and other apparatus to which a flowable material must be supplied at an elevated pressure.

A further object of the invention is to provide the machine with novel and improved means for reducing noise and with novel and improved means for controlling the flow of a working fluid to and from the motor.

An additional object of the invention is to provide a machine wherein the regulating means need not extend beyond the outline of the motor and/or pump housing and wherein the regulating means occupies space which is invariably available in such types of machines.

Another object of the invention is to provide the fluid flow machine with novel and improved means for effecting controlled discharge of spent gaseous fluid from the motor.

The improved fluid flow machine comprises a pump having a first reciprocable piston, a fluid operated motor having a second reciprocable piston which is coaxial with the first piston, means for coupling the first piston to the second piston, and means for regulating the operation of the motor. Such regulating means is adjacent the coupling means intermediate the motor and the pump. The motor is normally disposed at a level above the pump, and the machine further comprises a liquid-containing chamber which is disposed between the pump and the regulating means. The coupling means comprises a composite piston rod which extends through the chamber and is in contact with the liquid in the chamber. The regulating means is or can be disposed radially outwardly of the piston rod between the chamber and the motor.

The piston of the motor is designed to perform strokes of predetermined length, and the height of the regulating means (in the axial direction of the pistons) can approximate or match the length of such strokes. The machine can be provided with a common tubular envelope for the cylinder of the motor and for the regulating means, and such envelope is preferably permeable to air and surrounds an expansion chamber which receives spent gaseous fluid from the motor by way of the regulating means. Such design contributes to a reduction of noise when the machine is in use.

The motor is preferably a pneumatic motor, and the coupling means preferably comprises a piston rod which is reciprocable with the second piston to perform forward and return strokes of predetermined length. The regulating means can comprise a motion receiving member (e.g., a sleeve which surrounds the piston rod in the space above the liquid-containing chamber), motion transmitting means (e.g., a ring) provided on the piston rod and serving to move the motion receiving member during the last stage of each stroke of the piston rod, and at least one valving element which is movable by the motion receiving member to thereby regulate the flow of a gaseous fluid to and from the motor. The piston rod is movable relative to the aforementioned preferably sleeve-like motion receiving member within limits which are imposed by the motion transmitting means on the piston rod.

The just described regulating means can further comprise a housing including a first end wall which is mounted on the motor and a second end wall which is adjacent the liquid-containing chamber. The housing, the valving element, the motion receiving member and the motion transmitting means can jointly define a first internal space which receives pressurized gaseous fluid from a nipple or any other suitable means for admitting pressurized gaseous fluid. The housing is further formed with a second internal space, and the purpose of the valving element of such regulating means is to control the flow of fluid from the first space into the motor and from the motor into the second space in response to reciprocation of the piston rod which is connected to the piston in the cylinder chamber of the motor.

The motor preferably includes a first rigid end wall, and the liquid-containing chamber has a second rigid end wall which is spaced apart from the end wall of the motor so as to provide room for the regulating means between such end walls.

If the gaseous fluid which is supplied to the regulating means and thence into and from the chambers of the motor contains moisture, the machine is preferably further provided with means for collecting condensate which gathers in the regulating means. The condensate collecting means can include a pan which is disposed below the regulating means and above the liquid-containing chamber. The pan can form a separable or integral part of the bottom end wall of the aforementioned housing of the regulating means.

The pump is preferably a liquid conveying pump, and the presently preferred embodiment of the coupling means comprises a first piston rod which is connected to the first piston, a second piston rod which is connected to the second piston, and means for separably or more or less permanently connecting the first and second piston rods to each other. Such connecting means is located between the motor and the pump.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
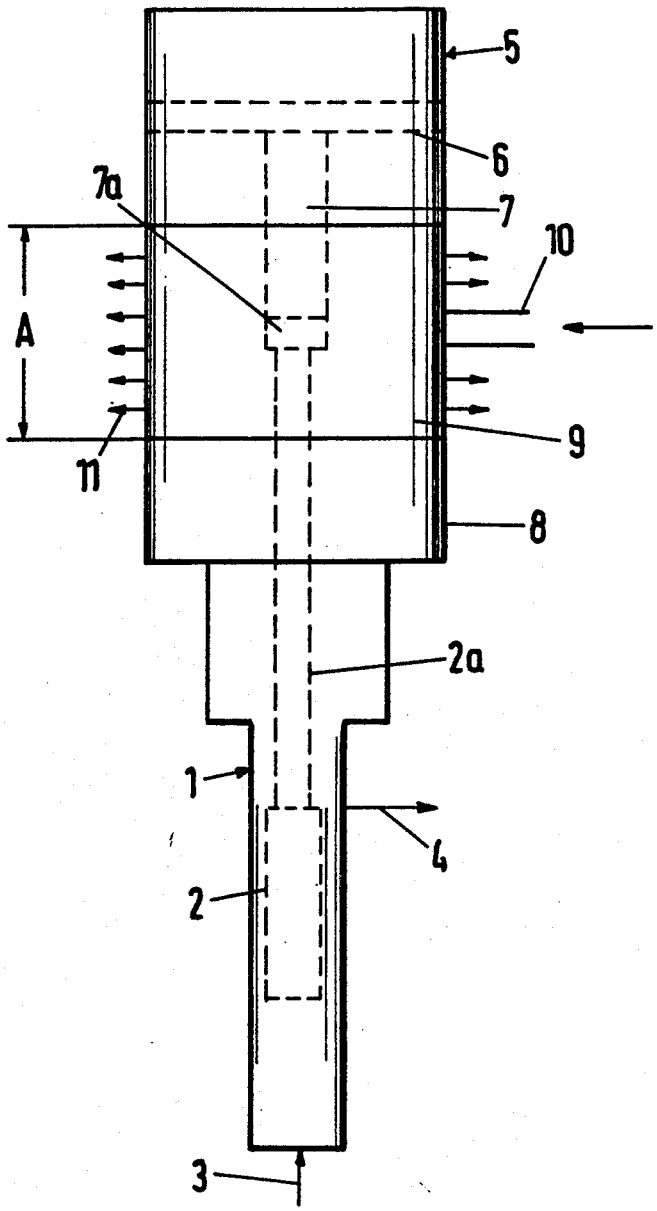
FIG. 1 is a schematic elevational view of a fluid flow machine which embodies one form of the invention.

FIG. 1 shows a fluid flow machine with a reciprocating piston type pump 1 and a pneumatic motor 5 whose piston 6 reciprocates the pump piston 2 through the medium of a composite coupling including a piston rod 2a which is connected with the piston 2, a piston rod 7 which is connected with the piston 6, and a connecting device 7a which is provided between the piston rods 2a and 7. The pump 1 draws a liquid (e.g., a paint to be sprayed) by way of the suction intake 3 and discharges highly pressurized liquid by way of the outlet 4. The pump 1 is disposed at a level below a liquid-containing chamber 8 which, in turn, is located below a regulating unit 9 for the motor 5. The housing of the motor 5 is spaced apart from the chamber 8 a distance A which approximates or equals the forward and return strokes of the pistons 2, 6 and of the coupling including the piston rods 2*a*, 7 and connecting device 7*a*. The piston rod 2*a* extends from the housing of the pump 1 during each of its strokes and is in contact with the supply of cleaning, rinsing and lubricating liquid in the chamber 8. The piston rod 2*a* extends through a seal (not shown) in the upper end wall of the housing of the pump 1, and the piston rod 7 extends through an annular seal 18 (FIG. 2) in the lower end wall 13 of the housing of the motor 5.

The distance A is selected in such a way that the connecting device 7*a* cannot come in contact with the aforementioned seal in the upper end wall of the pump housing and/or with the seal 18 in the rigid lower end wall 13 of the motor housing. Moreover, the distance A is selected with a view to ensure that remnants of paint or any other flowable material which is conveyed by the pump 1 cannot permanently deposit on the piston rod 7. To this end, the space between the chamber 8 and the motor 5 is occupied by the aforementioned regulating unit 9 which controls the flow of a pressurized gaseous fluid (normally air) to the grooves 35, 36 of the (double-acting) motor 5 when the fluid flow machine is in use to effect the flow of paint or the like from the suction intake 3 to the outlet 4 of the pump 1. The reference character 10 denotes a nipple which can be said to constitute a component part of the regulating unit 9 and receives compressed air or another suitable gaseous fluid from a suitable source, not shown. Spent air can leave the regulating unit 9 all the way around its circumference (through the pores or perforations of a tubular envelope 42 which surrounds the housing of the motor 5 and the entire regulating unit 9, see FIG. 2). This is indicated in FIG. 1 by arrows 11; however, it is equally within the purview of the invention to provide the regulating unit 9 with one or more discrete outlets for spent air which has been expelled by way of the groove 35 or 36 in the housing of the motor 5. Spent air can be discharged into the surrounding atmosphere or can be collected in a suitable vessel, not shown.

Figure 2:
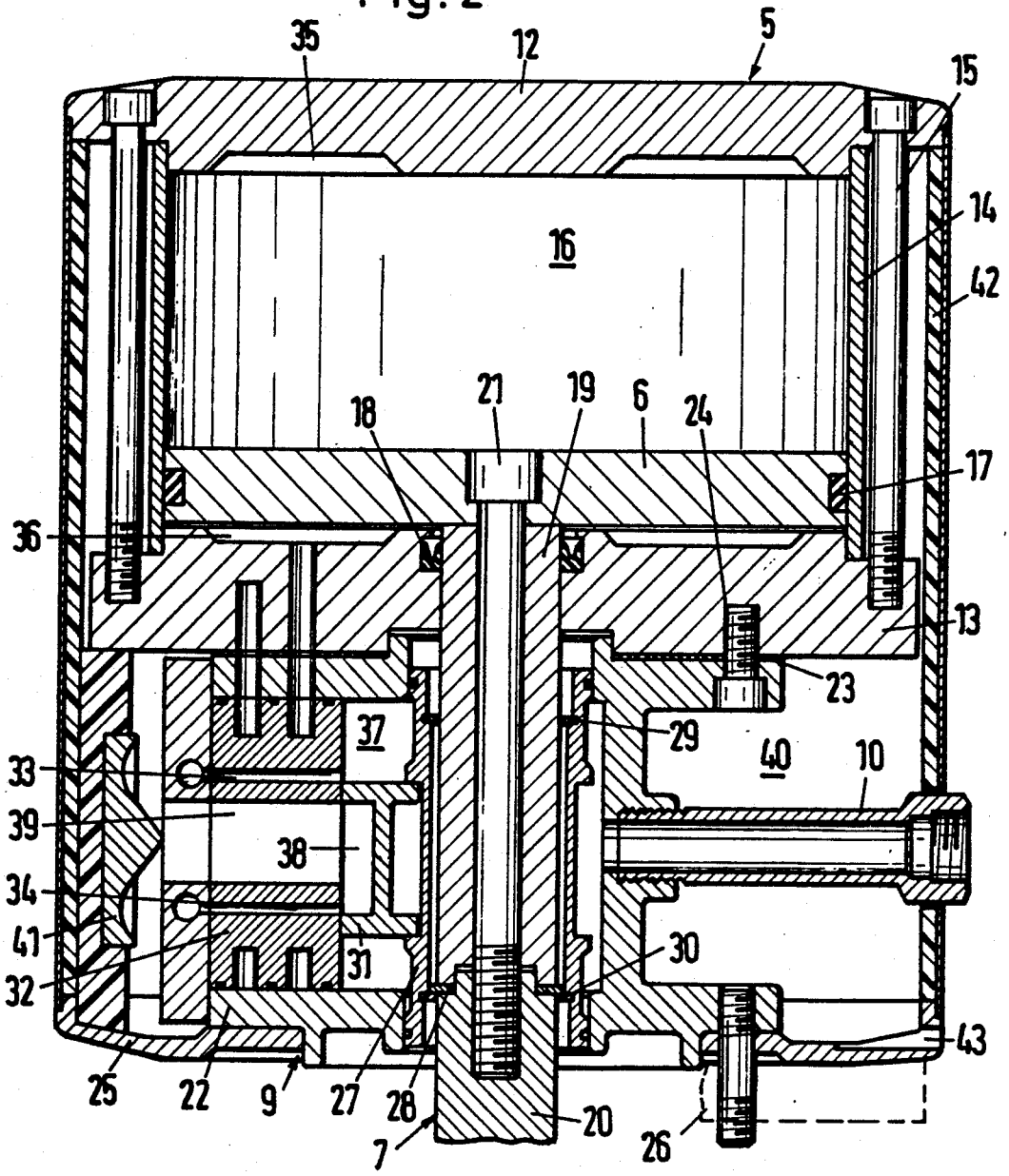
FIG. 2 is an enlarged fragmentary central vertical sectional view of the motor and regulating means in the fluid flow machine of FIG. 1.

The construction of one presently preferred embodiment of the motor 5 and of the associated regulating unit 9 is shown in FIG. 2. The motor 5 is a double-acting pneumatic motor which is or can be operated with compressed air and includes a housing having a top end wall 12, the aforementioned lower or bottom end wall 13, and a hollow cylindrical wall 14 between the end walls 12 and 13. The end walls 12, 13 are separably affixed to each other by bolts 15 or other suitable fasteners so that their inner sides are in sealing engagement with the respective end faces of the cylindrical wall 14. The walls 12–14 define a cylinder chamber 16 for the piston 6 which is affixed to the upper end portion of the piston rod 7. The peripheral surface of the piston 6 has a circumferentially complete groove for a ring-shaped seal 17 which engages the internal surface of the cylindrical wall 14. The piston rod 7 includes an upper section 19 which extends through the seal 18 in the bottom end wall 13, and a lower section 20 which is separably secured to the upper section 19 by a bolt 21 or another suitable fastener and extends into the housing 22 of the regulating unit 9. The illustrated fastener 21 not only connects the sections 19, 20 to each other but also fixes the section 19 to the piston 6 of the pump 5.

The upper end wall of the housing 22 of the regulating unit 9 abuts a seal 23 at the underside of the bottom end wall 13 and is affixed to the latter by screws 24 or other suitable securing means. The lower end wall of the housing 22 carries a separable closure or lid 25 which is affixed to the housing 22 and to the rigid top end wall 26 (shown in FIG. 2 by broken lines) of the chamber 8 by threaded bolts or the like.

The regulating unit 9 further comprises a sleeve-like motion receiving member 27 which surrounds the piston rod 7 and can be moved relative to the housing 22 through rather short distances by a motion transmitting ring 28 which is clamped between the sections 19, 20 of the piston rod 7. The arrangement is such that the ring 28 moves the sleeve-like member 27 during the last stage of each upward and each downward stroke of the piston 6. The ring 28 is disposed between abutments in the form of split rings 29 and 30 which are received in grooves machined into the internal surface of the member 27. The ring 28 lifts the member 27 through the medium of the ring 29 during the last stage of each upward stroke of the piston 6, and the ring 28 moves the member 27 downwardly through the medium of the ring 30 during the last stage of each downward stroke of the piston 6. The member 27 can move a valving element 31 which controls the flow of air into and from the grooves 35, 36 at opposite sides of the piston 6 by way of channels 33, 34 in a block-shaped air distributing member 32 in the housing 22 of the regulating unit 9. In the illustrated lower end position, the valving element 31 seals a space 37 from the channel 34 but permits this space to communicate with the channel 33. At the same time, a space 38 in the housing 22 is sealed from the channel 33 but is free to communicate with the channel 34.

The nipple 10 admits compressed air into the space 37 whence the air flows into the groove 36 via channel 33 so that the piston 6 is caused to move from the illustrated lower end position toward its upper end position to thereby lift the piston 2 as well as to expel air from the cylinder chamber 16 via groove 35, channel 34, space 38 and a passage 39 of the member 32. The passage 39 connects the space 38 with a large expansion chamber 40 which surrounds the housing 22 and is surrounded by the foraminous envelope 42. As can be seen in FIG. 2, the expansion chamber 40 has a portion which surrounds the bottom end wall 13 and extends all the way around the cylindrical wall 14 of the motor housing. Thus reduces the likelihood of the generation of pronounced noise when the fluid flow machine is in use. A conical distributor 41 is provided in the expansion chamber 40 at the discharge end of the passage 39 to ensure uniform distribution of spent air in the chamber 40. Such air escapes into the surrounding atmosphere (arrows 11 in FIG. 1) through the pores or perforations of the envelope 42.

When the piston 6 reaches the upper end of its stroke, the ring 28 has already lifted the motion receiving member 27 and valving element 31 via ring 29 so that the valving element 31 connects the groove 36 with the channel 33 (and hence with the expansion chamber 40) while the groove 35 is connected with the space 37 so that it can receive compressed air from the nipple 10, i.e., the piston 6 then descends and moves the piston 2 downwardly. The same operation is repeated again and again, as long as the nipple 10 continues to receive compressed air from a fan or the like, not shown.

The envelope 42 can be replaced with an impermeable envelope if the regulating unit 9 is provided with one or more discrete conduits for evacuation of spent air from the chamber 40.

The aforementioned closure or lid 25 on the rigid top end wall 26 of the chamber 8 constitutes a collecting vessel or pan for condensate which is likely to gather in the housing 22 if the nipple 10 admits moisture-containing air. The upwardly extending rim at the periphery of the pan 25 is provided with one or more openings 43 for controlled evacuation of condensate.

A regulating unit which is similar to the regulating unit 9 of FIG. 2 is embodied in a diaphragm pump of the type known as 001.085-DP which is distributed by the assignee of the present application. The illustrated regulating unit 9 can be replaced with any other suitable unit which can regulate the operation of the pump 5 and is sufficiently compact to the accommodated in the space between the rigid top end wall 26 of the chamber 8 and the rigid bottom end wall 13 of the motor 5 radially adjacent the piston rod 7. All that counts is to ensure that the selected regulating unit provides room for the piston rod 7 and that it comprises satisfactory means for automatically altering the direction of flow of air from groove 35 and into the chamber 36 or vice versa upon completion of each stroke of the pistons 2, 6 and of the coupling including the piston rods 2*a*, 7 and the connecting device 7*a*. It is preferred to design the regulating unit in such a way that it need not extend radially beyond the outline of the pump 1 and/or motor 5 and also that the regulating unit ensures satisfactory suppression of noise when the fluid flow machine is in use.

An important advantage of the improved fluid flow machine is that its dimensions (in the radial and/or axial direction of the pump 1 and motor 5) need not be increased for the purpose of accommodating the regulating unit 9. In other words, the regulating unit occupies space which is already available in a fluid flow machine with a chamber 8 for a supply of liquid which cleans, rinses and lubricates the piston rod 7. Moreover, the piston rod 7 can mechanically engage and reciprocate the motion receiving member 27 of the regulating unit 9 so that it is not necessary to provide additional valves and valve actuators as in the aforediscussed conventional fluid flow machines. Therefore, the housing of the motor 5 need not be provided with additional openings for parts which are to actuate the movable components of the regulating unit, i.e., the motor housing must be provided with a single opening (in the bottom end wall 13) for the piston rod 7. Still further, the improved fluid flow machine provides a large expansion chamber 40 to thus ensure a highly satisfactory suppression of noise when the piston 6 is caused to reciprocate in response to admission of compressed air via nipple 10. As shown, the regulating unit 9 can occupy the entire space between the chamber 8 and the bottom end wall 13 of the motor 5 so as to take advantage of each and every portion of such space, either for reception of component parts of the regulating unit or to contribute to the dimensions of the expansion chamber 40. The motion receiving member 27 of the regulating unit 9 can be reciprocated directly by the ring 28 between the sections 19, 20 of the piston rod 7 so that it is not necessary to employ a step-down transmission between the piston 6 and the valving element 31. This contributes to simplicity of the regulating unit 9 as well as to a reduction of the number of parts and hence to the dimensions of the expansion chamber 40.

The envelope 42 exhibits the advantage that it provides a large area for escape of spent air from the regulating unit 9 as well as that it contributes to the appearance of the fluid flow machine and shields the component parts of the regulating unit and motor 5. Moreover, and as shown in FIG. 2, the envelope 42 renders it possible to greatly enlarge the expansion chamber 40 because the latter can extend all the way between the condensate collecting pan 25 and the top end wall 12 of the motor 5.

The illustrated motion transmitting connection between the piston rod 7 and the valving element 31 is simple, compact, inexpensive and reliable. The parts in the housing 22 of the regulating unit 9 can reliably seal the spaces 37 and 38 from each other during each stage of movement and in each end position of the valving element 31. The walls 13 and 26 are preferably solid so that they reduce the likelihood of transfer of structure borne noise.

The pan 25 constitutes an optional but desirable and advantageous feature of the improved fluid flow machine. Its purpose is to prevent penetration of condensate into the chamber 8 where it could affect the quality of the lubricating, rinsing and washing medium. Therefore, such medium need not be exchanged at frequent intervals. The pan does not contribute to the bulk of the regulating unit 9 and/or to the bulk of the fluid flow machine because it can constitute or form part of the lower end wall of the housing 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A fluid flow machine comprising a pump having a first reciprocable piston; a fluid-operated motor having a second reciprocable piston coaxial with said first piston; means for coupling said first piston to said second piston, including a reciprocable piston rod; means for regulating the operation of said motor, said regulating means being adjacent said coupling means intermediate said motor and said pump; a liquid-containing chamber disposed intermediate said regulating means and said pump at a level beneath said regulating means, said piston rod extending through said chamber and being in contact with the liquid in said chamber, said regulating means being disposed radially outwardly of said piston rod and having means for supplying moisture-containing gaseous fluid to and for receiving moisture-containing gaseous fluid from said motor so that condensate is likely to gather in said regulating means; and means for collecting condensate intermediate said regulating means and said chamber.

2. The machine of claim 1, wherein said collecting means includes a pan beneath said regulating means.

3. The machine of claim 1, wherein said regulating means comprises a housing having a bottom wall which includes said collecting means.

4. A fluid flow machine comprising a pump having a first reciprocable piston; a double-acting pneumatic motor having a second reciprocable piston coaxial with said first piston; means for coupling said first piston to said second piston; means for regulating the operation of said motor, said regulating means being adjacent said coupling means intermediate said motor and said pump and comprising means for supplying a compressed gaseous fluid and valve means for admitting fluid to and for effecting evacuation of fluid from said motor in response to reciprocation of said pistons; and means defining an expansion chamber surrounding said regulating means, said regulating means further including a passage for admission of gaseous fluid into said chamber.

5. The machine of claim 1, wherein said motor is disposed at a level above said pump.

6. The machine of claim 4, wherein said pump is a liquid pump.

7. The machine of claim 4, wherein said coupling means comprises a reciprocable piston rod and further comprising a liquid-containing chamber disposed intermediate said regulating means and said pump, said piston rod extending through said liquid-containing chamber and being in contact with the liquid in said liquid-containing chamber, said regulating means being disposed radially outwardly of said piston rod.

8. The machine of claim 7, wherein said second piston has a stroke of predetermined length and said regulating means has a height in the axial direction of said pistons which at least approximates said predetermined length.

9. The machine of claim 3, wherein said motor includes a first rigid end wall and said liquid receiving chamber has a second rigid end wall spaced apart from said first end wall, said regulating means being disposed between said end walls.

10. The machine of claim 7, wherein said motor further includes a cylinder for said second piston and further comprising a common tubular envelope for said cylinder and said regulating means.

11. The machine of claim 10, wherein said envelope is permeable to air.

12. The machine of claim 7, wherein said coupling means further comprises a second piston rod which is reciprocable with said second piston to perform forward and return strokes of predetermined length, said regulating means comprising a motion receiving member, motion transmitting means provided on said second piston rod to move said member during the last stage of each stroke of said second piston rod, and a valving element movable by said motion receiving member to thereby regulate the flow of a gaseous fluid to and from said motor.

13. The machine of claim 12, wherein said motion receiving member comprises a sleeve surrounding said piston rod, said piston rod being movable relative to said sleeve within limits imposed by said motion transmitting means.

14. The machine of claim 12, wherein said regulating means further comprises a housing including a first end wall mounted on said motor and a second wall adjacent said chamber, said housing defining with said valving element, said member and said motion transmitting means a first internal space and said regulating means further comprising means for admitting into said space a pressurized gaseous fluid, said housing further having a second internal space and said valving element being operative to control the flow of fluid from said first space to said motor and from said motor to said second space in response to reciprocation of said second piston rod.

* * * * *